US005785501A

United States Patent [19]

Van Coillie et al.

[11] Patent Number: 5,785,501

[45] Date of Patent: Jul. 28, 1998

[54] LIQUID PUMP WITH DEGASSER AND INTEGRATED VAPOR RECOVERY OPTION

[76] Inventors: André Sylvere Joseph Van Coillie, Rue du Château 47A, B-1480 Clabecq, Belgium; Johannes Hendrikus Cornelis Marie Bultman, Christinestraat 9, NL-5401 CZ Uden, Netherlands

[21] Appl. No.: 524,455

[22] Filed: Sep. 6, 1995

[30] Foreign Application Priority Data

Sep. 7, 1994 [NL] Netherlands ..... 9401455

[51] Int. Cl.[6] ..... F04C 19/00

[52] U.S. Cl. ..... 417/69; 417/423.14; 141/59

[58] Field of Search ..... 417/423.3, 69, 417/423.14, 424.1; 137/202; 415/143; 141/59

[56] References Cited

U.S. PATENT DOCUMENTS

| | | | |
|---|---|---|---|
| 2,306,988 | 8/1942 | Adams . | |
| 4,260,000 | 4/1981 | McGahey et al. | 141/59 |
| 5,494,409 | 2/1996 | Webb et al. | 417/313 |
| 5,575,629 | 11/1996 | Olson et al. | 141/59 |

FOREIGN PATENT DOCUMENTS

| | | |
|---|---|---|
| 197944 | 8/1938 | Switzerland . |
| 350551 | 6/1931 | United Kingdom . |
| 372952 | 5/1932 | United Kingdom . |
| 724652 | 2/1955 | United Kingdom . |
| 2 181 487 | 4/1987 | United Kingdom . |

*Primary Examiner*—Timothy Thorpe
*Assistant Examiner*—Peter G. Korytnyk
*Attorney, Agent, or Firm*—Evenson, McKeown, Edwards & Lenahan P.L.L.C.

[57] ABSTRACT

The invention relates to a pumping device for volatile liquid, comprising a closed pump housing having an intake connected to a supply reservoir and at least one discharge connected to a delivery means. The device further comprises a liquid pump with a liquid inlet drawing into the interior of the pump housing and a pressure outlet connected to the discharge, a gas pump with a gas inlet drawing into the pump housing at a high level and a gas outlet debauching outside the pump housing and wherein the liquid pump is a hydrodynamic pump such as a centrifugal pump.

14 Claims, 2 Drawing Sheets

LIQUID PUMP WITH DEGASSER AND INTEGRATED VAPOR RECOVERY OPTION

BACKGROUND OF THE INVENTION

The invention relates to pumps such as fuel pumps as are used at petrol filling stations.

Fuel pumps are mainly provided with gear pumps or pumps of the kind having an eccentric rotor with blades moving in and out.

These pumps are self-priming, contain a by-pass valve to allow the quantity of pumped petrol which is not pumped to the outside through the hose and the nozzle to return into the suction channel and are equipped with a gas separator which ensures that the measured fuel does not contain any gas.

The drawbacks of these pumps are:

- A number of components making frictional contact and subject to wear;
- The necessity of a by-pass valve which inter alia is a source of noise;
- A large number of components;
- A degassing which is difficult to effect and which makes a sight-glass necessary on the majority of petrol pumps.
- Recovery of expelled vapour is only possible by means of expensive separate equipment.

SUMMARY OF THE INVENTION

The invention has for its object to provide a pump of the kind set forth above, in which at least a number of these disadvantages are eliminated.

According to the invention this object is achieved with a pumping device for volatile liquids, comprising a closed pump housing having an intake connected to a supply reservoir and at least one discharge connected to a delivery means, a liquid pump with a liquid inlet drawing fuel into the interior of the pump housing and a pressure outlet connected to the discharge, a gas pump with a gas inlet drawing gas from the pump housing at an upper wall thereof and a gas outlet debauching gas outside the pump housing, and wherein the liquid pump is a hydrodynamic pump such as a centrifugal pump.

Despite its many advantages for fuel pumps at petrol filling stations, a hydrodynamic pump such as a centrifugal pump is not used, among other reasons because it is not self-priming.

The advantages of the pumping device according to the invention in addition to the fact that it is self-priming, are as follows:

- It does not require a by-pass valve as its flow rate, within the maximum limit, is solely dependent on the total system resistance and thus, in the case of petrol pumps, mainly on the nozzle opening;
- It has a very simple construction and therefore a favourable cost price;
- It has markedly better gas separation properties;
- It has a much better intrinsic safety in terms of fuel leakage compared to existing pumps;

With the characterizing measures as defined in the subclaims, pumping devices can be obtained having one or more of the following additional advantages:

- It can possess an integrated vapour recovery function. In addition to the gas separated from the liquid it will also exhaust at least as much gas as its maximum liquid flow rate;
- It can be designed for two pump discharges which are each provided inside the pumping device with a servo valve. This embodiment has a significantly lower cost price than the classic pumps which in most cases require per hydraulic unit two external (expensive) electromagnetic valves;
- In the case a liquid ring pump is used for the vacuum pump according to a preferred embodiment, the pump mechanism has, with the exception of one slide bearing, no components making frictional contact. It is therefore not susceptible to frictional wear and consequently requires practically no maintenance.

While on the one hand the hydrodynamic pump draws in the fuel for pumping from the lower part of the pump housing after the gas bubbles present in the drawn-in fuel have separated and accumulated against the upper wall of the pump housing, on the other hand the vacuum pump exhausts the gas accumulated against the upper wall of the pump housing, so that in normal conditions the pump housing remains optimally filled with fuel and the hydrodynamic pump can always draw gas-free fuel from the lower part of the pump housing.

Degassing of the fuel takes place in a more efficient manner than in prior art pumping devices.

In prior art fuel pumps the fuel is drawn in by the pump together with the gas bubbles present therein and forced under pressure to a gas separation chamber in which a mean pressure of about 2 bar prevails. The gas bubbles which separate from the fuel are therefore under a pressure of 2 bar and are consequently smaller than under atmospheric pressure (approximately half as large).

The gas separation in the pumping device according to the invention takes place before the pump brings the fuel under pressure, that is, in the pump housing which during pumping is under an underpressure of at least ⅓ bar.

The gas bubbles are therefore at least ⅔ larger than under atmospheric pressure and more than twice as large as in prior art pumps.

Since the upward force and thus the speed with which the gas bubbles are forced to the upper part of the pump housing also depends on their size, the gas separation will take place significantly faster than in prior art pumps.

The pump according to the invention has a gas separation volume that is at least twice as large which markedly decreases the entraining of gas bubbles due to the (lower) liquid speed in the pump housing.

The vacuum pump can easily be designed such that, in addition to the exhausting of the gas separated from the fuel, enough suction capacity still remains available to exhaust the gases from the fuel tank of the vehicle during filling in the case a "vapour recovery" system is installed.

The dispenser is then equipped with a special filling nozzle with exhaust collar, a coaxial hose, the inner conduit of which is used to exhaust the gas, and a mechanically or electrically driven proportional control valve.

In a preferred embodiment the pump discharges are each provided with a servo valve of very compact construction built into the pump and based on a spring-loaded membrane and activated either by an electromagnetic valve mounted on the top outer side of the pump housing or by the lowest position of a float in the pump housing.

BRIEF DESCRIPTION OF THE DRAWINGS

The invention will be further illustrated in the following description referring to the enclosed figures.

DETAILED DESCRIPTION OF THE DRAWINGS

Figure 1:
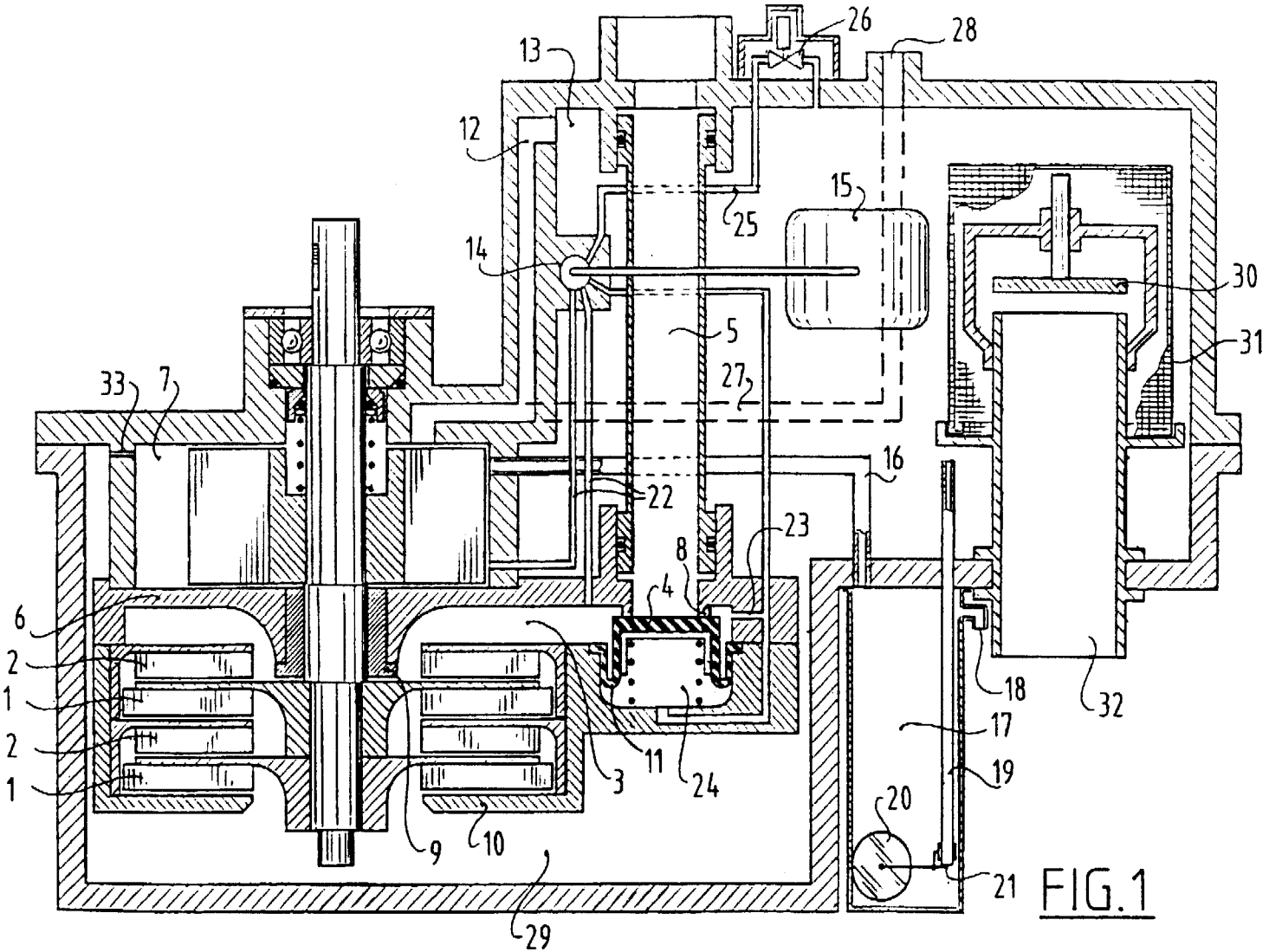
FIG. 1 shows schematically a cross section of a pumping device according to a preferred embodiment of the invention, without vapor recovery.

In FIG. 1 the hydrodynamic fluid pump is a two-stage centrifugal pump consisting of two rotors (1), two stators (2) and a pressure chamber pump discharge (3). The pressure chamber pump outlet (3) is provided with at least one servo valve (4) and at least one pressure conduit (5) which exits the pump housing at the top.

The whole unit consists of two pump halves whereof the upper half (6) forms the bottom wall of the liquid ring pump (7) and also the upper wall of the pressure chamber (3) . It also contains the lower shaft bearing (9) and at least one servo valve seat (8).

The lower half (10) contains the two stators (2) and has at least one recess in which the servo valve membrane (11) is fixed.

Disposed on the same shaft as that of the hydrodynamic pump and just above the latter is a liquid ring pump of which the intake (suction) debouches by means of a suction pipe (12) against the upper wall of the pump housing (13).

The discharge (16) of the liquid ring pump is either connected directly to a vapour return conduit which carries the gas and a part of the priming liquid back to the (underground) tank or debouches into a collecting vessel (17) into which the liquid ring pump spews the gas compressed to atmospheric pressure together with a part of the priming liquid. Herein the gas is separated from the fuel and passes into the atmosphere through opening (18). A suction pipe (19) provided on the bottom with a valve (21) controlled by a float (20) is connected to the pump housing and debouches herein above the maximum fuel level. When the fuel rises high enough in the collecting vessel (17) float (20) opens the valve (21) and suction pipe (19) empties the collecting vessel so far that the valve closes again due to the falling float.

In the case no "vapour recovery" system is connected the priming liquid required for the liquid ring pump is supplied from the pressure chamber (3) along a calibrated channel (22). This feed is controlled by one valve of the combined valve (14) which is activated by the up and downward movement of the float (15).

Figure 2:
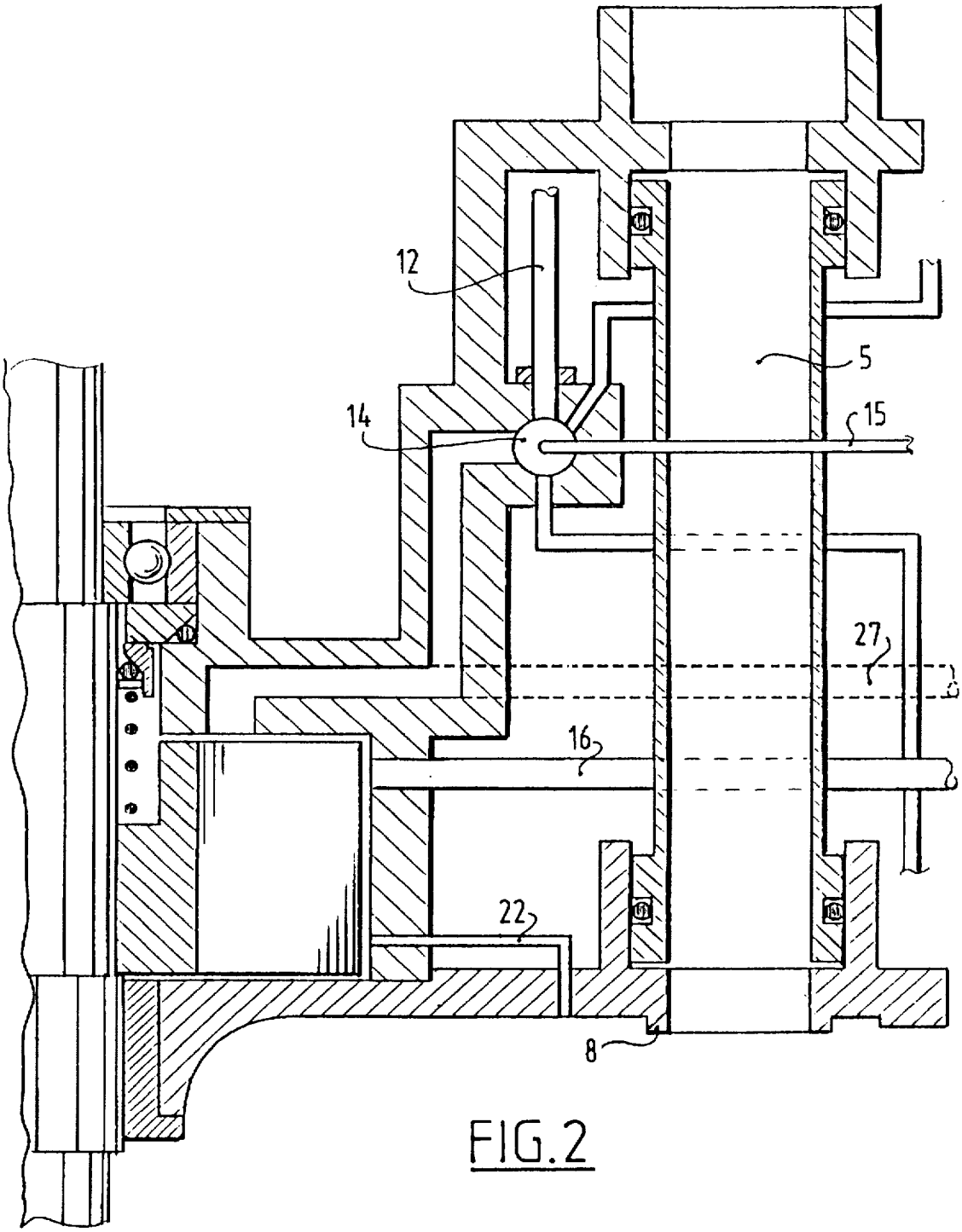
FIG. 2 shows a portion of a pumping unit with vapor recovery system, and further corresponding to FIG. 1.

In the case a "vapour recovery" system is connected the suction channel (12) runs through the combined valve (14) instead of channel (22) which then directly connects pressure chamber (3) to the liquid ring pump (see FIG. 2).

The integration of the servo valve in the cast structure of the hydrodynamic pump is an important cost-saving factor. The servo valve mounted in the pressure chamber (3) consists of a valve seat (8), a spring-loaded valve membrane (11), a connecting channel (23) between pressure chamber (3) and valve chamber (24) and a connecting channel (25) between valve chamber and pressure chamber on the one side and the pump housing on the other. The connecting channel (25) runs first through a valve of the combined valve (14) and thereafter through an electromagnetically driven valve (26) before debauching into the pump housing.

The diameter of channel (25) is greater than that of channel (23). This provision ensures that the liquid pressure inside the valve chamber (24) dissipates as soon as the channel (25) between the valve chamber and pump housing opens.

The servo valve is activated either by the position of the float (15) or by the electromagnetic valve (26) driven from the register of the petrol pump.

The float (15) follows the fuel level in the pump housing and with its up and downward movement activates the combined valve (14) consisting of two or three valves, one or two of which can close the connecting channels which connect the valve chamber(s) (24) to the pump housing and the other of which closes either the feed of the priming liquid for the liquid ring pump or the suction channel (12).

In the case the pump forms part of an installation equipped with a "vapour recovery" system it has a gas exhaust intake (28) which is connected along the branch (27) to the intake of the liquid ring pump.

The suction capacity of the liquid ring pump is greater than the sum of the suction flow rates necessary on the one hand for exhausting the separated gases in the pump housing and on the other for the gases for exhausting in the petrol tank of the vehicle. The exhausted gases are then guided back to the (underground) fuel tank by means of a gas return conduit installed at the station. The liquid ring pump discharge (16) is then connected directly to this gas return conduit and the collecting vessel (17) with accessories is not mounted on the pump.

The embodiment of the pumping device according to the invention as shown in FIG. 1 operates as follows.

In normal operating conditions the pump housing (13) is optimally filled with fuel. The hydrodynamic pump draws in the fuel from the lower part (29) of the pump housing and presses it outside the pump along the pressure conduit (5). The pressure conduit has a servo valve (4) which is activated either by the float position or by an electrical signal coming from the register of the petrol pump.

The liquid ring pump (7) exhausts the gas which as accumulated against the upper wall of pump housing (13) and forces it outside the pump. This keeps the pump housing optimally filled with fuel and ensures that the hydrodynamic pump always remains immersed in the fuel. A foot valve (30) prevents the fuel present in the pump housing from flowing back to the (underground) tank when the pump is stationary.

A float mechanism (15) activates a combined valve (14) which controls opening and closing of the connecting channel (25) between the servo valve chamber (24) and the pump housing and of either the feed channel (22) of the priming liquid for the liquid ring pump or of the suction channel (12) (see FIG. 2). When the pump motor is started the hydrodynamic pump draws fuel from the lower part of the pump housing which hereby comes under underpressure and consequently draws fuel from the (underground) tank along the suction conduit (32) and through filter (31).

This arrangement makes possible leakage of fuel to the outside impossible. (In all currently used pumps the pump housings are under an overpressure of 2 to 3 bar, which entails a danger of leakage).

The drawn-in fuel contains a quantity of gas bubbles which, once in the pump housing, have the time to separate from the fuel and to collect against the upper wall of the pump housing.

As described before the degassing takes place under underpressure and is consequently much more efficient than in existing pumps.

Without "vapour recovery" system the fuel level in the pump housing is controlled as follows:

The liquid ring pump exhausts the separated gas, compresses it to atmospheric pressure and forces it outside the pump. The fuel level in the pump housing, and consequently also the float position, rise to their highest level. The valve (14) activated by the float closes the feed channel (22) of the priming liquid of the liquid ring pump, which has the following consequences: The priming liquid present in the liquid ring pump is pressed by the hydrodynamicforce through opening (33) back into the pump housing. This loss is always compensated by the supply of priming liquid along channel (22).

opening (33) however allows less priming liquid to escape than is supplied along channel (22). The difference in the two flow rates is discharged along pump discharge (16) together with the gas compressed to atmospheric pressure.

If the supply of priming liquid is now closed by valve (14), all liquid is then discharged from the liquid ring pump through opening (33) and pumping stops. The liquid ring pump rotor now rotates without effect in an empty pump housing.

This provision in the first place prevents the liquid ring pump also drawing in liquid along the gas exhaust pipe (12) after exhausting all the gases.

It also ensures that the liquid ring pump only uses power when it must effectively pump and that it idles when it does not have to exhaust gases. (If no "vapour recovery" system is installed the liquid ring pump idles for the greater part of the time).

A pump which is used with a "vapour recovery" system is embodied as described with reference to FIG. 2. This modification is necessary because the liquid ring pump must exhaust gases as soon as the pump delivers fuel, this irrespective of whether or not suction channel (12) is closed.

During the upper part of the float progress the valve (14) opens the connecting channel (25) which allows the fuel pressed from the pressure chamber (3) through channel (23) to flow away so that there is no build-up of pressure in the valve chamber (24). The liquid pressure on the outside of the valve membrane presses open the valve (4) whereby the spring is compressed. The fuel in the pressure chamber is discharged from the pump along the pressure conduit (5).

When, due to the accumulation of the gas bubbles, the fuel level, followed by the float position, falls, the valve (14) opens the channel (22) of the priming liquid feed (or the suction pipe 12) and liquid ring pump exhausts the gas. The fuel level rises and the float again closes channel (22) (or 12).

In normal conditions this mechanism keeps the fuel level in its optimum position. Should the quantity of gas in the pump housing rise more quickly than the speed at which the liquid ring pump exhausts the gas (for instance when a tank is empty), the fuel level then falls and therefore also the float in the pump housing.

In the first instance this opens the channel (22) (or suction pipe 12). Should the float approach its lowest position however, valve 14 then closes the connecting channel (25) of the servo valve. The pressure inside the valve chamber (24) builds up due to the connecting channel (23) until it equals the pressure in the pressure chamber, and the spring pushes the valve against its valve seat. The servo valve hereby closes the pressure conduit and the pump flow rate falls to zero. The fuel remaining in the pump housing is now only used as priming liquid for the liquid ring pump which at full capacity exhausts the gases present in the pump housing. In the "vapour recovery" version a closed servo valve has the result that the gas suction channel is closed by the proportional control valve so that the full suction capacity of the liquid ring pump is available for self-priming of the hydrodynamic pump.

After for instance re-filling of the empty (underground) tank the air in the suction conduit between tank and pump will have to be exhausted. The liquid ring pump does this at great speed. When the fuel reaches the pump housing again it causes the float to rise which, through interposing of the valve (14), re-opens the servo valve so that the pump begins to discharge again.

Although the pump forming the subject of the invention can have one or two pump discharges, each provided with a servo valve and accessories, for the purpose of simplifying the text one pump discharge is assumed in the description of its components and its operation.

In the description a liquid ring pump is used as a vacuum pump. This has the advantage that the construction does not have any components making frictional contact and that the whole unit can be realized quite simply and compactly. The fuel for pumping is used as priming liquid for the liquid ring pump.

However any other vacuum pump can be applied since the combination of degassing the fuel under underpressure, the integrated vapour recovery and the self-priming are not dependent on the type of vacuum pump.

In the foregoing description the hydrodynamic pump according to the invention is embodied as centrifugal pump. However any other hydrodynamic pump, such as an axial rotor pump can also be used. In the context of the present application the word "hydrodynamic" refers to the generation and use of a force field for obtaining the pumping action and is to be seen in contrast with "hydrostatic" in which distinct fluid volumes, separated from the flow, are transported from the first environment to a second environment with usually a higher pressure than the first environment.

What is claimed is:

1. Pumping device for volatile liquids, comprising a closed pump housing having an intake connected to a supply reservoir and at least one discharge connected to a delivery means, a liquid pump with a liquid inlet drawing fuel into the interior of the pump housing and a pressure outlet connected to the discharge, a gas pump with a gas inlet drawing gas from the pump housing at an upper wall thereof and a gas outlet debouching gas outside the pump housing, and wherein the liquid pump is a hydrodynamic pump such as a centrifugal pump.

2. Pumping device as claimed in claim 1, wherein the hydrodynamic pump is mounted in the pump housing and the liquid inlet thereof is arranged at a lower level than the intake of the pump housing.

3. Pumping device as claimed in claim 2, wherein the gas pump is mounted in the pump housing.

4. Pumping device as claimed in claim 2, wherein the hydrodynamic pump and the gas pump each comprise at least one rotor which is mounted on a common shaft.

5. Pumping device as claimed in claim 4, wherein the common shaft is carried in sealed manner through a wall of the pump housing and is rotatably connected to a drive shaft of an electric motor disposed outside the pump housing.

6. Pumping device as claimed in claim 5, wherein the electric motor is mounted on the pump housing.

7. Pumping device as claimed in claim 1, wherein the gas pump is a liquid ring pump.

8. Pumping device as claimed in claim 7, comprising a narrow connecting channel between the pressure outlet of the hydrodynamic pump and the pump chamber of the liquid ring pump.

9. Pumping device as claimed in claim 1, wherein between the pressure outlet of the liquid pump and each discharge of the pump housing a servo valve is arranged comprising a valve member arranged movably in a chamber, a spring urging the valve member into contact with a valve seat, and wherein a connecting channel is arranged connecting the chamber to an upper portion of the pump housing such that when the chamber is connected with an underpressure via the connecting channel the valve member is moved away from the valve seat counter to the action of the spring, and an electrically operated control valve, normally closed, arranged in the connecting channel.

10. Pumping device as claimed in claim 9, wherein in the connecting channel is arranged a normally opened valve actuated by a float mounted in the pump housing, which valve closes the connecting channel when the float falls below a predetermined level.

11. Pumping device as claimed in claim 1, wherein in the gas inlet of the gas pump is arranged a normally opened valve actuated by a float mounted in the pump housing, which valve closes the gas inlet when the float rises above a predetermined level.

12. Pumping device as claimed in claim 1, wherein the gas outlet debouches into a reservoir which is provided with a drain channel which is connected to the pump housing and in which is arranged a normally closed valve actuated by a float mounted in the reservoir, which valve opens the drain channel when the float rises above a predetermined level.

13. Pumping device as claimed in claim 1, wherein a suction channel connected to the gas inlet extends to a position close to the delivery means.

14. Pumping device as claimed in claim 13, wherein the delivery means is connected by a hose to the discharge of the pump housing and the suction channel extends through the hose.

* * * * *